US010745085B2

(12) United States Patent
McGarian

(10) Patent No.: US 10,745,085 B2
(45) Date of Patent: Aug. 18, 2020

(54) SECURITY DEVICE

(71) Applicant: Global Shieldtech Ltd., Aberdeen (GB)

(72) Inventor: Bruce McGarian, Stonehaven (GB)

( * ) Notice: Subject to any disclaimer, the term of this patent is extended or adjusted under 35 U.S.C. 154(b) by 0 days.

(21) Appl. No.: 16/073,711

(22) PCT Filed: Jan. 31, 2017

(86) PCT No.: PCT/GB2017/050239
§ 371 (c)(1),
(2) Date: Jul. 27, 2018

(87) PCT Pub. No.: WO2017/134423
PCT Pub. Date: Aug. 10, 2017

(65) Prior Publication Data

US 2019/0031294 A1 Jan. 31, 2019

(30) Foreign Application Priority Data

Sep. 2, 2016 (GB) ..... 1641956.9

(51) Int. Cl.

| | |
|---|---|
| ***B63B 17/04*** | (2006.01) |
| ***B63G 13/00*** | (2006.01) |
| ***E04H 17/00*** | (2006.01) |
| *B63B 3/10* | (2006.01) |

(52) U.S. Cl.
CPC ..... *B63B 17/04* (2013.01); *B63G 13/00* (2013.01); *E04H 17/003* (2013.01); *B63B 3/10* (2013.01)

(58) Field of Classification Search
CPC ..... B63B 3/10; B63B 13/00; B63B 17/04; B63B 17/003
See application file for complete search history.

(56) References Cited

U.S. PATENT DOCUMENTS

| | | | | |
|---|---|---|---|---|
| 2,283,484 A * | 5/1942 | Bak | B63B 3/10 114/13 |
| 3,573,150 A * | 3/1971 | Broutnnan et al. | B32B 27/00 428/105 |
| 2009/0014490 A1* | 1/2009 | Bradley | A45C 13/008 224/576 |

FOREIGN PATENT DOCUMENTS

| | | |
|---|---|---|
| GB | 2496757 A | 5/2013 |
| GB | 2524012 A | 9/2015 |
| GB | 2526610 A | 12/2015 |
| KR | 20140001219 U | 3/2014 |

OTHER PUBLICATIONS

International Search Report and Written Opinion dated May 2, 2017 in International Patent Application No. PCT/GB2017/050239, 18 pages.

* cited by examiner

*Primary Examiner* — Stephen P Avila
(74) *Attorney, Agent, or Firm* — Shook, Hardy & Bacon LLP

(57) ABSTRACT

A security device comprising: a barrier, and a plate, wherein the barrier and the plate are releasably attachable to each other, and when the barrier and plate are attached the device comprises a slot for receiving a rail and the device may hang on a rail with the rail received in the slot, and the barrier protrudes in a horizontal direction, perpendicular from a plane extending downwardly from the rail, to provide an overhang; and wherein at least a portion of the plate is made from a bullet-resistant material.

15 Claims, 4 Drawing Sheets

SECURITY DEVICE

CROSS-REFERENCE TO RELATED APPLICATIONS

This application entitled "Security Device" is a 35 U.S.C. § 371 national stage application of PCT Application Number PCT/GB2017/050239, filed Jan. 31, 2017, and entitled "A Security Device", which claims priority to British Patent Application No. GB1601762.6, filed Feb. 1, 2016, and British Patent Application No. GB1614956.9, filed Sep. 2, 2016. The entirety of the aforementioned applications are incorporated by reference herein.

BACKGROUND TO THE INVENTION

The invention relates to a security device and in particular concerns a device for improving the security of a ship. More specifically, the invention relates to a modular security device where at least one part of the device is made from bullet resistant material.

In recent years there have been several examples of commercial cargo ships being boarded by pirates. This type of even can present a serious threat to the wellbeing of the crew of the ship, as well as being commercially damaging.

As ship owners and operators have become increasingly aware of the problem, they have begun to improve the security of the ship by placing security barriers over the rails of the ship to make the ship more difficult to board. Removable bulwarks are attached to the peripheral edges of a ship, such as a ship's rail. The barrier element typically has a bulbous shape which provides an overhang when the device is attached to a ship's rail. The barrier is attached to a support element which attaches to the rail. Examples of such devices are disclosed in WO2013/072704 Stevens and PCT/GB2015/053749 McGarian.

While these devices are useful to prevent boarding of the ship, they are typically made from moulded polymer plastic material to keep costs and weight to a minimum. Pirates are increasingly turning to measures such as firearms, such as an AK-47 which fires a 7.62 mm bullet. Moulded polymer plastic material provides little protection from a fire arms attack, which may be launched from a distance away from the ship. For example, it is generally accepted that an AK-47 is accurate up to a range of about 300 m.

It is an object of the present invention to provide an improved security barrier that provides better protection for the crew.

SUMMARY OF THE INVENTION

Aspects of the invention are set out in the accompanying claims.

According to an aspect of the invention a security device comprising: a barrier; and a plate, wherein the barrier and plate are releasably attachable to each other, and when the barrier and plate are attached the device comprises a slot for receiving a rail and the device may hang on a rail with the rail received in the slot, and the barrier protrudes in a horizontal direction, perpendicular from a plane extending downwardly from the rail, to provide an overhang; and wherein at least a portion of the plate is made from a bullet-resistant material is provided.

Further, both the plate and the barrier have at least one attachment point for securing the device to a rail.

According to another aspect of the invention, a security device comprising: a barrier; and a panel, wherein, the security device may be transitioned repeatedly between a first configuration and a second configuration, in the first configuration the security device is unassembled and at least the barrier may be arranged in a storage configuration in which the barrier curves or bends through a first angle, and in the second configuration the security device is assembled in an arrangement for use, in which the security device may be assembled around a rail; and wherein, in the second configuration, at least a part of the panel is orientated to be substantially vertical, and the barrier is curved, bent or folded through a second angle, which is greater than the first angle, to protrude away from the panel in a horizontal direction, perpendicular from a plane extending vertically through the rail, to provide an overhang on an exterior side of the rail; and wherein at least a portion of the panel is made from a bullet-resistant material is provided.

According to another aspect of the invention a kit comprising: a plate, a barrier and a plurality of attachment means, wherein the plate and the barrier may be releasably attached to each other and a rail using the plurality of attachment means, and wherein at least a portion of the plate is made from a bullet-resistant material is provided.

Two or more security devices, which may have bullet-resistant parts or no bullet-resistant parts, may, be arranged with respective sides of each of the security devices positioned in close proximity to form a substantially continuous barrier.

Thus, bullet-resistant security devices may be used to protect critical deck areas of a ship and non-bullet-resistant security devices may be used to protect non-critical deck areas.

Further, the bullet-resistant portion of a device may have voids, wherein, in use, the voids may be filled with an energy absorbent material, preferably wherein the energy absorbent material is water or sand.

Thus, another aspect of the invention provides a method of providing bullet-resistant protection, comprising the steps of: securing one or more security device according to a perimeter rail; and filling the void with water via a hose attached to an inlet in the device or filling the void with sand.

Accordingly, a security device and method of protecting critical and non-critical areas using one or more security devices is provided. The arrangements of various aspects of the invention have a number of advantages. For example, the bullet-resistant portion of the device provides increase security for the ship and crew from incoming fire attack. By having just a portion of the device made from bullet-resistant materials, the additional cost and addition weight of the devices, compared with a non-bullet-resistant device are kept to a minimum. Various optional aspects of the invention are intended to achieve these advantages.

For example, the bullet-resistant material may be a composite material, a laminate material, a mesh, a curtain or sheet metal, or the bullet-resistant portion of the plate may further comprises a layer of material which is non-bullet-resistant and laminated with the bullet-resistant material. Another portion of the barrier may be made from a different second material, such as a moulded polymer plastic material, similarly to non-bullet-resistant type devices.

Thus, the bullet-resistant devices may be used interchangeably with non-bullet-resistant type devices. Accordingly, the two types of devices may have the same outward appearance as each other so that it is more difficult for an outside viewer to determine which devices a bullet-resistant and which devices are not bullet-resistant.

The bullet-resistant material may be selected to provide a protection level as provided in various standards. For example, the plate may be at least a Type I bullet-resistant item, or preferably at least a Type II bullet-resistant item, or preferably at least a Type II bullet-resistant item, or preferably at least a Type III bullet-resistant item, or preferably at least a Type IV bullet-resistant item.

Furthermore, the shape of the device may provide protection from attackers looking to gain access to the area behind a wall of installed devices. For example, a security device may be designed wherein the barrier is bulbous and extends in a direction perpendicular to the plane of the plate. Thus, making it difficult to climb over the device.

For example, a security device may have a plate which extends below the bottom edge of the barrier, or wherein the plate extends over a first height and the barrier extends over a second height which is shorter than the first height, or wherein, in use, the plate and the barrier may be adjustably positioned relative to each other to correspondingly adjust the overall height of the device. Or a security device may be designed wherein the shape of the plate and the barrier are complementary, for example the plate may further comprises an angled portion, proximate to the upper edge thereof for fitting to a complementary shape of the barrier.

Thus, the devices are suitable for use in a number of different locations and may be secured to a range of different existing rails, walls and fences etc. It is not required that the devices are used on rails with specific dimensions as the devices may be adjusted to fit. Furthermore, the devices may be adjusted to provide at least protection for the entire height of the rails. If for example, non-bullet-resistant devices are designed with a similar shape, certain components of the devices may be interchangeable.

Still further, the shape of the devices may be designed with a specific use in mind. For example, where it is intended that the device will be used to protect a ship, the device will be secured to the perimeter rails. Certain design features may be incorporated into the device for the specific use. For example, the plate may comprise an angled portion, proximate to the lower edge thereof to allow water to drain under the device from the ships deck over the edge of the ship. Alternatively or in addition, the plate further comprise a hinge across the lower part of the plate so that the lower part of the plate may swing to provide an opening at the bottom of the device, and optionally, the device may further comprise at least one leg which extends beyond the bottom of the lower part of the plate and in use supports the device to allow the lower part of the plate to swing. In a different arrangement but not incompatible arrangement, the plate may have a kink below the barrier so that the upper portion and at least a section of the lower portion of the plate are parallel, and the lower portion of the plate is displaced in the same direction as the overhang so that the plate passes through rails and be fitted securely to the rails.

Other arrangements, variations and advantages will become apparent from the following description.

BRIEF DESCRIPTION OF THE FIGURES

In order that the present invention may be more readily understood, embodiments thereof will now be described, by way of example, with reference to the accompanying drawings, in which.

DESCRIPTION OF INVENTION

Figure 1A:
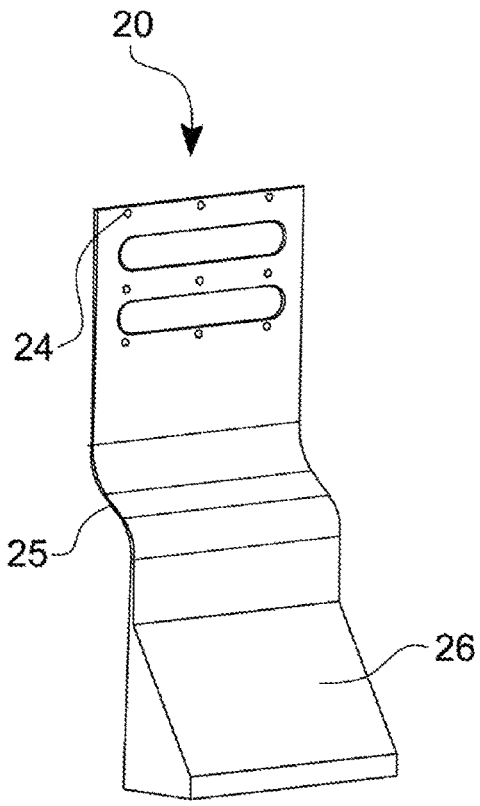
FIG. 1*a* illustrates a side-front perspective view of a plate.

The invention relates to a security device. In overview, the security device has an inboard portion and an outboard portion. A number of devices may be secured to the rails or walls of a ship, around the periphery or edge, to provide protection to the crew behind the rails or walls.

In the specification terms such as 'top', 'bottom', 'side', 'front', 'back', 'height', 'width' and 'depth' are used. Terms such as 'inboard' and 'outboard' refer to the components relative to their position to the wall of a ship. It should be understood that these refer to the components when they are installed in the manner described and depicted herein, and not in any other orientation.

Security barriers 10 of the type disclosed herein typically comprise two main parts: a plate 20 and a barrier 30. An example of a security barrier 10 is illustrated in FIGS. 1*a* to 1*c*.

Usefully, the barrier 30 and plate 20 are separate pieces, i.e. the device 10 is modular. As illustrated in FIGS. 1*a* to 1*c*, the barrier 30 has a back section 39 which provides a slot between the inboard portion and the outboard portion of the barrier 30. The upper portion of the plate 20 has a complementary shape compared with the back section 39 of the barrier 30. The plate 20 and back section 39 also have corresponding attachment points 24. Thus, the security device 10 is in two parts that may fit together. The plate 20 extends over the height of the device 10 and the barrier 30 provides an overhang.

Figure 1B:
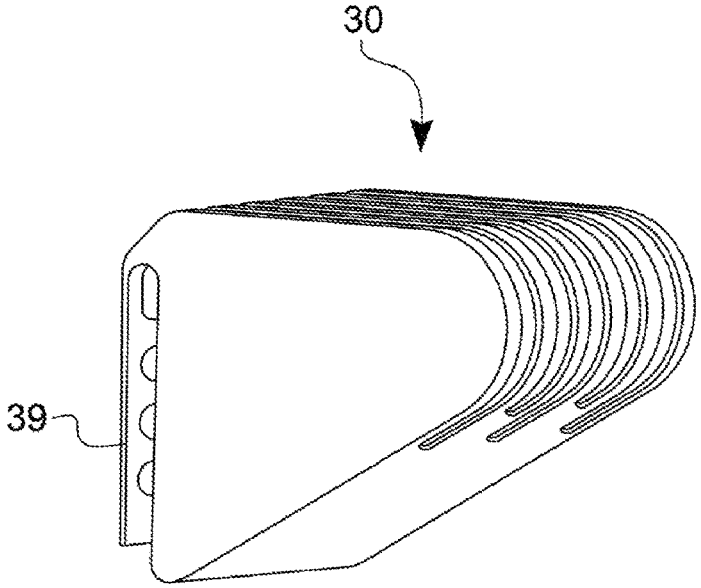
FIG. 1*b* illustrates a side-front perspective view of a barrier.
Figure 1C:
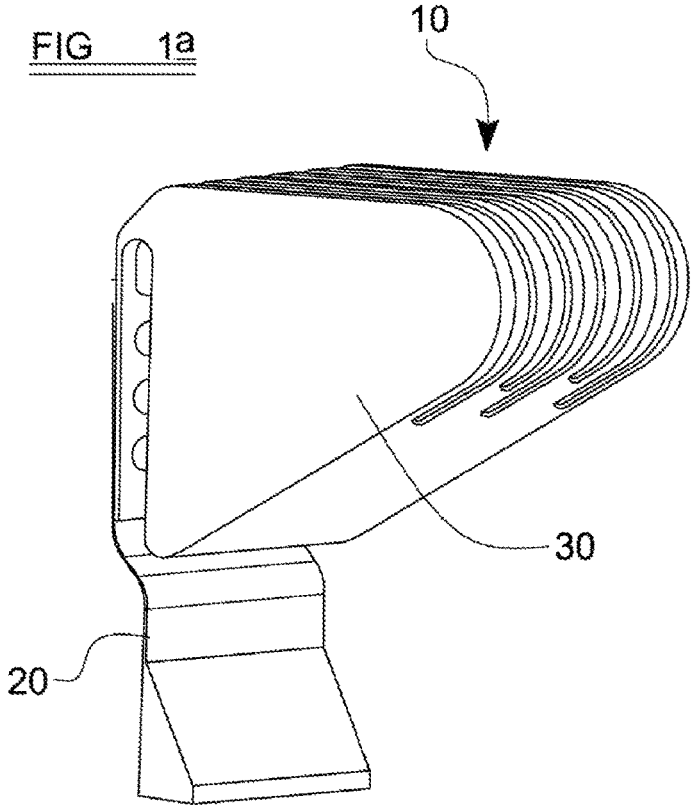
FIG. 1*c* illustrates a side-front perspective view of a security device.

In the example illustrated in FIGS. 1*a* to 1*c*, the plate 20 has a S-shaped kink 25 and a kick portion 26. The kink is located below the bottom edge of the barrier 30, and the kick portion is located proximate to the bottom edge of the plate 20. The kink or 'S' bend 25 is suitably sized so that, in use, the device 10 may rest on the rail of a ship and the kink 25 bends around an intermediate rail, discussed in more detail below.

In use, the device 10 may be arranged on a rail with the front portion of the barrier 30 and the lower portion of the plate 20 outboard of the rail, and the upper portion of the plate 20 behind the barrier 30 and inboard of the rail. The plate 20 and barrier 30 are attached to each other and to the rail using the attachment points 24.

It is not necessary for the plate 20 to comprise a kink 25 so that it extends through the rails. FIGS. 2*a* to 2*d* illustrate other examples of plates 20. These may be used interchangeably with suitable barriers 30 and other parts of a device 10.

Figure 2A:
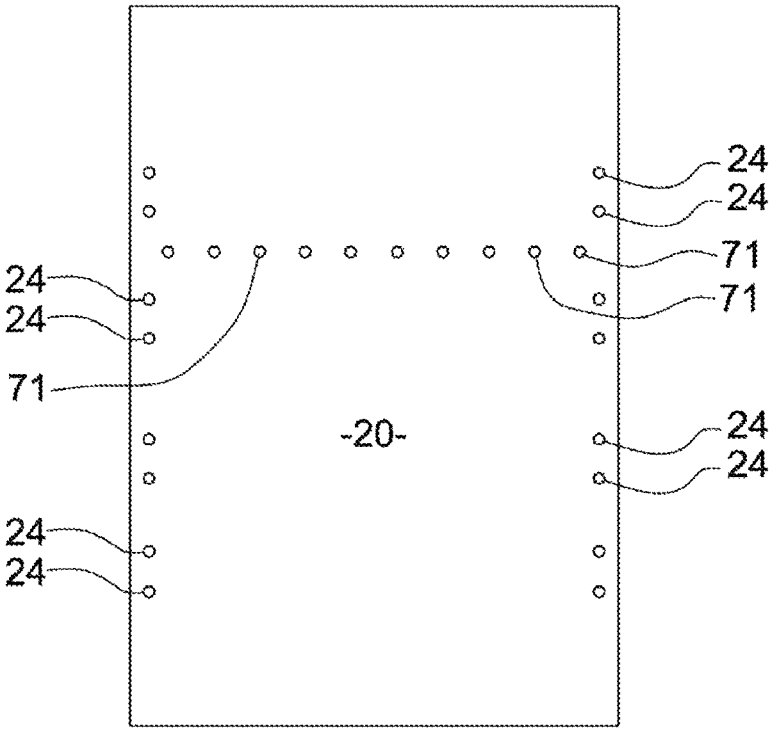
FIGS. 2*a*-2*c* illustrate various plates that may be used with a modular security device.

FIG. 2*a* illustrates a simple flat plate 20. Attachment points 24 are provided at various heights for fixing the plate to a barrier 30 and rail.

Figure 2B:
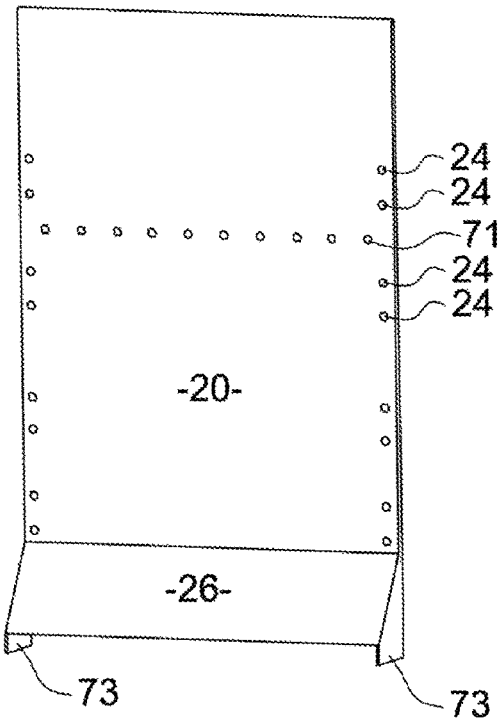

FIG. 2*b* illustrates a plate 20 with a kick portion 26. The kick portion 26 kicks out or extends at an angle in an outward direction. Feet 73 may extend from the bottom of the kick portion 26 in order to provide a gap for drainage from inboard of the security device 10 adjacent to a ship deck in use. Similarly to the plate 20 illustrated in FIG. 2*a*, the plate 20 illustrated in FIG. 2*b* has a series of attachment points 24.

Figure 2C:
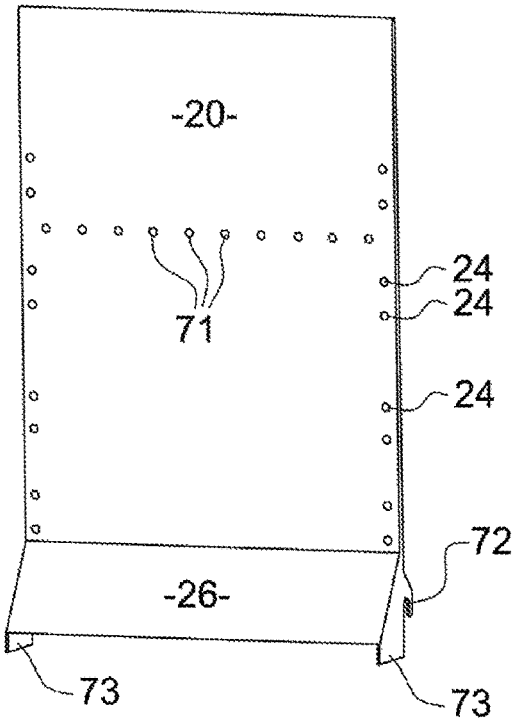

FIG. 2*c* illustrates another plate 20. This plate 20 has similar features to those shown in FIG. 2*b*. In addition, extending from the inboard side of the plate 20, proximate to the kick portion 26, the plate is provided with downward facing hook like grip feature 72 extending from the side of the kick portion 26. The grip 72 is suitably sized to fit over a ship's kick board.

Figure 2D:
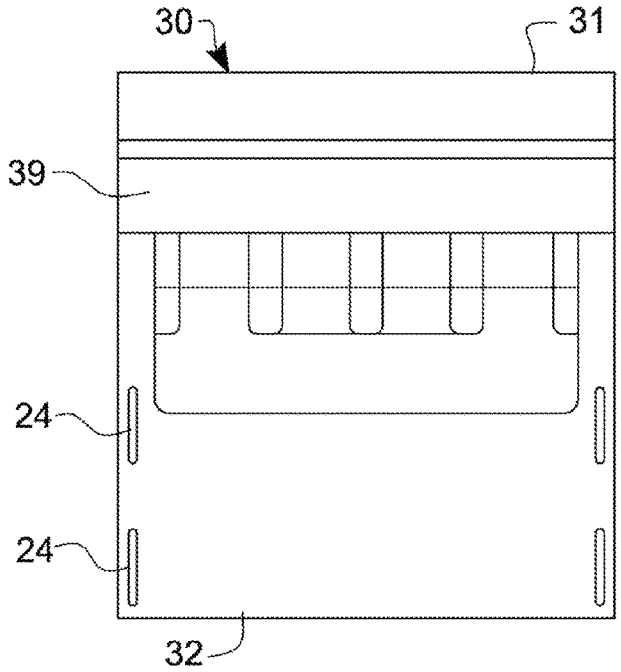
FIG. 2*d* illustrates a front/back plane view of a plate.

FIG. 2*d* illustrates another plate 20. This plate 20 is a flat plate version. The attachment points 24 are both small round holes and elongate slots. The plate comprises a hinge 27 so that the hinged section below may swing, allowing water to pass through the security device 10 for drainage. When installed, the hinge 27 may be located just below a middle rail.

In the examples illustrated herein, at least a portion of the plate 20 is made from a bullet-resistant material. In some examples, the whole plate 20 may be used from a bullet-resistant material.

At least a portion of the plate is made from a bullet-resistant material such as Kevlar™, Twaron™, GoldFlex™, polycarbonate, carbon fibre, ballistic nylon, 'plastic metal', laminated glass, ceramics, composite materials—for example resin bonded plastic and sand, or sheet metal such as steel or titanium, or combinations thereof. A bullet-resistant material is any material that is capable of stopping a bullet or similar high velocity projectile. In practice, bullet-resistant materials may not be capable of providing complete protection against all types of bullets or multiple hits in the same location.

Body armour may be classified by categorised by NIJ standard-0101.04 or Underwriters Laboratories (UL) standard UL752 into types or levels. For example according to the NIJ standard, Type 1 is the lightest classified protection and protects against 0.22 long rifle lead round nose bullets with a mass of 2.6 g impacting at a velocity of 320 m/s. Type IV "Armor Piercing Rifle" protects against .30 calibre armour piercing bullets with a mass of 10.8 g and impacting at a velocity of 869 m/s. The UL standard classifies materials as Level 1 to Level 8. In general, the higher the type/level the greater the level of protection but the materials are generally thicker, weigh more and are more expensive.

A level III bullet proof vest made from Dragon Skin™ is suitable for protection from fire from an AK-47. Dragon Skin™ is made from overlapping disks of silicon carbide ceramic matrices.

Vehicle armour may be classified according to different criteria and may typically use different materials that those used for body armour. For example, approximately 1 cm thick mild steel is suitable for stopping fire from an AK-47.

Other suitable materials include tempered or folded steel, and bullet-resistant fiberglass.

The thickness of the plate may be varied to provide varying level of protection. The pay off with increasing the thickness is an increased cost and weight.

However, excessive increased weight may be mitigated against by using a laminate composite material, which has greater strength and resilience than the sum of its parts. For example, a bullet-resistant material may be laminated with a non-bullet-resistant material such as the same material as the barrier 30, or the bullet-resistant material itself may be laminated.

In an arrangement with two sheets of steel, separated by a void, the void may be filled with an absorbent material such as sand or water. Thus, while the outer layer may be penetrated by a bullet the filled void will act as a shock absorber and dissipate most of the remaining energy the bullet has and the bullet will not be able to penetrate through the second layer of material. Filling the voids with water has the advantage that water will be readily available. Also, the voids may be filled once the device is in situ. If the device is to be removed or relocated, the voids may first be drained so that the devices are not unduly heavy. Thus, the device would include an inlet and outlet for filling the voids. For example, a ship will typically have at least one pump for pumping sea water onto or out of the ship, e.g. to be used as a water cannon or to empty bilges. The pump may be connected to the device, via a hose, for filling the voids.

In arrangements where composite fibre materials are used, the bullet-resistant fibres are typically crossed-laid and held together by a matrix or other material. Each of the layers may contribute to the effectiveness of the item.

The weight of devices may be limited due to limitations on the ships weight capacity and distribution of weight that may be placed on the deck. Therefore, more expensive lighter weight arrangements may be preferred.

Another relative light weight arrangement is using meshes to form the bullet-resistant layer. For example, meshes which are laid with each other, orientated in different directions, and moulded to form a suitable shape could provide suitable bullet-resistant properties. Gaps between the mesh and layers of the mesh could provide air-gaps or could be filled with water or sand. The bullet-resistant properties of the form would result both from the material used to form the mesh and the structure of the mesh itself. The degree of 'openness' of the mesh would be selected to provide appropriate properties.

Figure 3A:
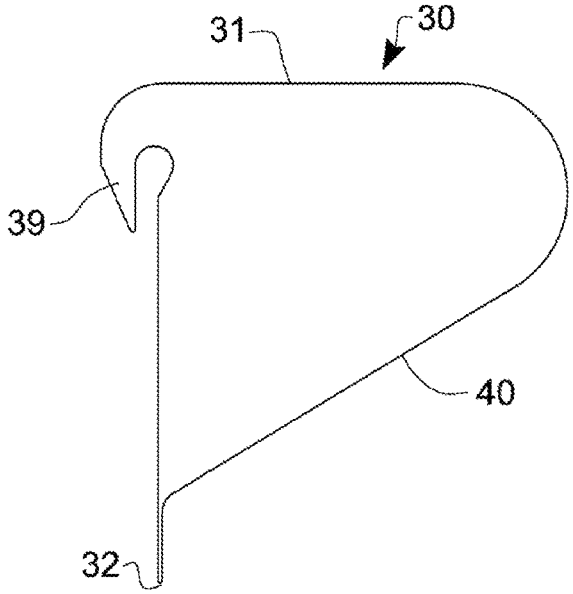
FIG. 3*a* illustrates a back plane view of a barrier.
Figure 3B:
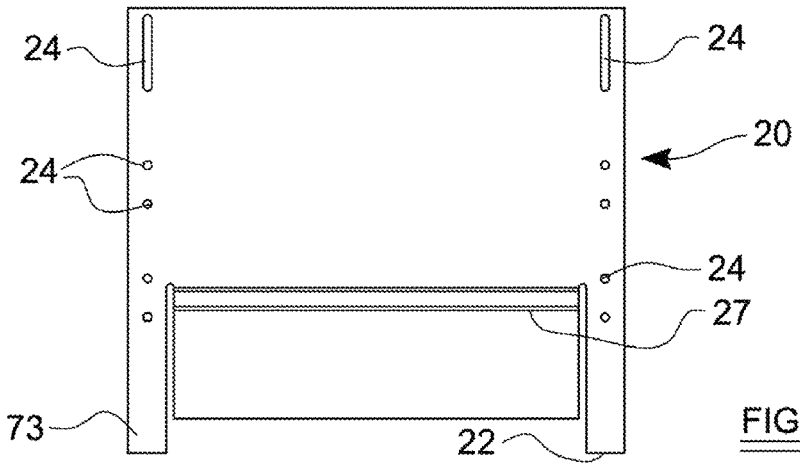
FIG. 3*b* illustrates a side plane view of a barrier.

FIGS. 3*a* and 3*b* illustrate an example of a barrier 30. The barrier 30 has a short back section 39 that forms a hook or trough for receiving a rail. The barrier 30 has elongate attachment points 24 that may be used for fitting the barrier 30.

For each of the components, the attachment points 24 are a series of small holes through which cable ties or other similar means may be threaded and secured around the railings 61. The attachment points 24 of the device 10 may be used to releasably attach the security device 10 to the ship's rail 61, to secure the security device 10 in position and to prevent the security device 10 from being removed by someone located outboard of the ship. Of course, other suitable attachment means are contemplated by the inventor.

As will be familiar to the skilled person, the deck of a ship typically has railings near its outer edge or perimeter, comprising a top rail and at least one intermediate rail. These are raised above the surface of the deck. The decks of many ships also include a short upstanding kick board which runs around the perimeter of the deck, at or near the edge thereof, substantially directly beneath the top rail. The kick board performs the function, among others, of preventing dropped objects from rolling off the desk of the ship.

Figure 4A:
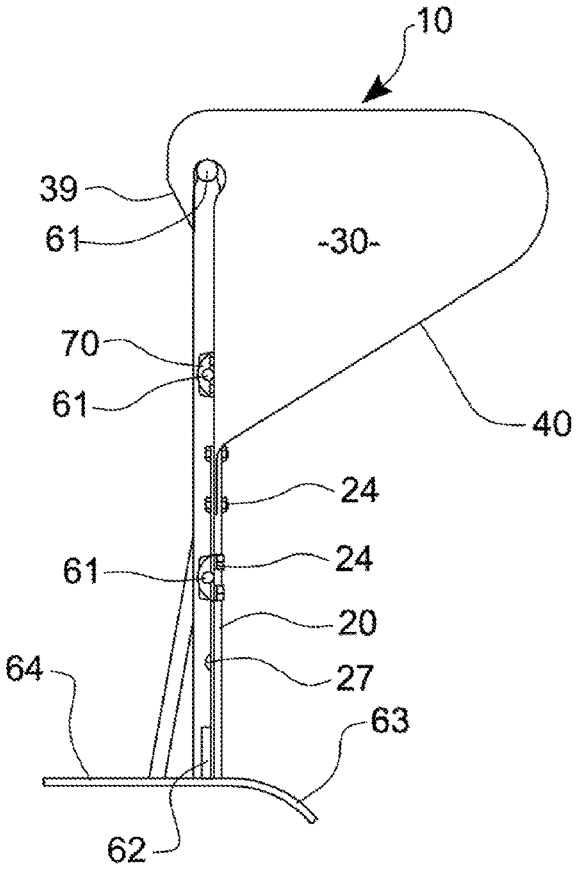
FIGS. 4*a* and 4*b* illustrate an installed modular security device.
Figure 4B:
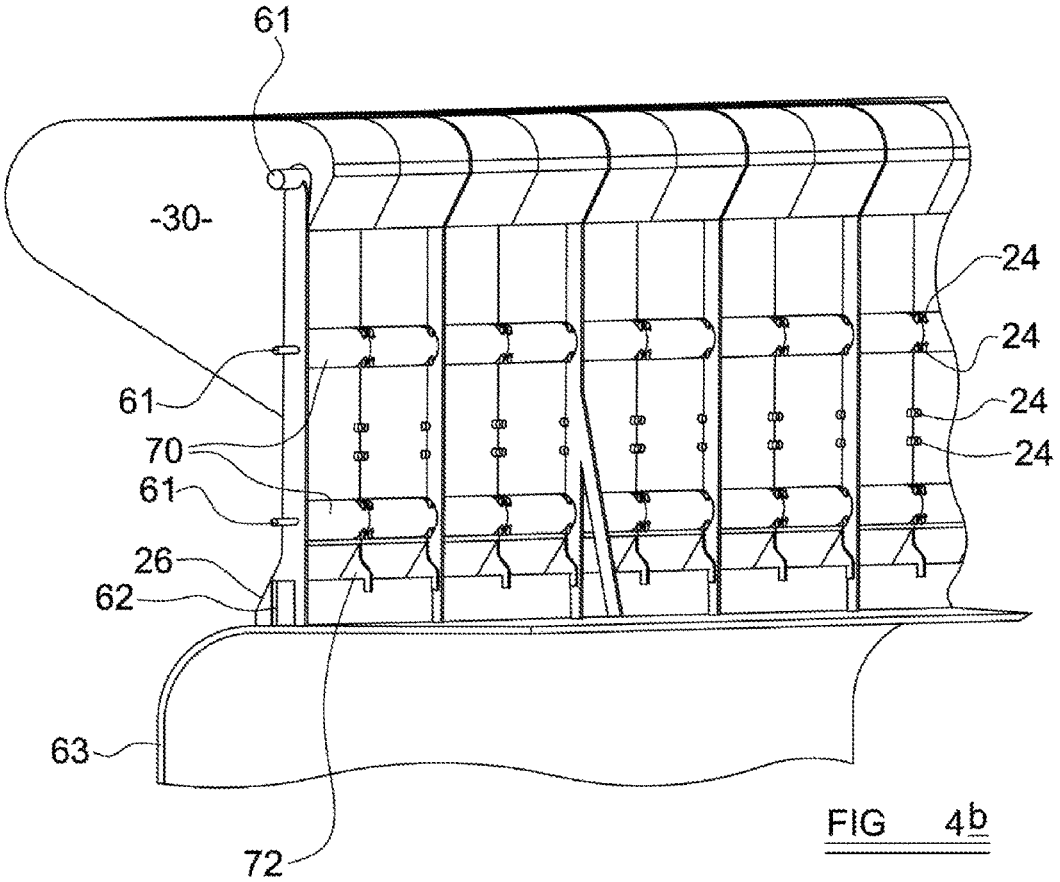

A series of security devices 10 attached to the rails of a ship are illustrated in FIGS. 4*a* and 4*b*.

FIGS. 4*a* and 4*b* illustrate an installed modular security device 10 from a side view perspective and a series of installed modular security devices 10 from a back side view perspective respectively. The modular security device 10 illustrated uses a plate 20 of the type illustrated in FIG. 2*c* and barrier 30 of the type illustrated in FIG. 3*b*. The barrier 30 fits over the top rail 61. The plate 20 is located between the overhang of the barrier 30 and the rails with the grip feature 72 fitting over the kick plate. In addition, device 10 is provided with batons 70 over the intermediate and lower rails 61.

The uppermost attachment points 24 on the plate 20 are used to fix the plate to the intermediate rail 61 and baton 70.

The intermediate attachment points 24 are used to fix the plate 20 to the barrier 30. The lowermost attachment points 24 are used to fix the plate 20 to the lowermost rail 61. The kick grip 72 fits neatly over the kick board 62. As can be seen in FIG. 4*b* the plate 20 is of a height to cover the open back/inboard side of the barrier 30. In other arrangements, the height of the plate 20 may be varied so that it does not cover or fully cover the back of the barrier 30. As will be understood from the foregoing, the device 10 thus provides a bullet-resistant shield over the height of the device 10. Furthermore, the device 10 provides an overhang at the perimeter of a ship.

As the device 10 is modular, made up from at least a plate 20 and a barrier 30, it will be apparent from the foregoing that the most suitable plate 20 and barrier 30 combination may be used for a particular location. Further, the shape of plate 20 may be varied dependent on the materials it is made from.

As discussed above, typically at least a portion of the plate 20 is made from a bullet-resistant material. Different areas of the plate 20 may be made thicker or from different materials with a higher, lower or no classification of bullet-resistance. Further, plates 20 with non-bullet-resistant materials may be made. The plates 20 may be interchangeable for use with similar or custom barriers 30. Thus, around the perimeter or rails of a ship, different levels of protection from projectiles may be provided. For example, the outermost rails may be provided with security devices 10 which have a lower level of bullet-resistance protection than security devices 10 used to protect the bridge of the ship. Thus, lighter cheaper materials are used in the majority of locations and fewer heavily armoured security devices 10 used in vital locations.

In practice, it is unlikely that a whole vessel would need to be protected with bullet-resistant devices 10. Areas such as crew accommodation are typically constructed from steel which is likely to provide enough protection from incoming bullet fire, so these parts would not need a bullet-resistant device 10 fitted to the surrounding rails. However, near to crew accommodation areas it would be reasonable to provide devices 10 with additional ballistic protection so that the crew may move safely between locations. Ballistically protected areas may be termed 'critical deck areas'.

Where the plate 20 and or barrier 30 have elongate attachment points 24, the exact positioning of the plate 20 may be adjusted relative to the ships rails 61 and the barrier 30. The elongate attachment points may be used to correspondingly adjust the overall height of the device 10 as required at a specific location.

As discussed above, at least a portion of the plate 20 is made from a bullet-resistant material. The materials from which the remaining parts of the security device 10 are formed may allow the components to flex sufficiently to be robust against any knocks which are likely to occur during use and transportation. Portions of the security device 10 may be made from materials that are readily recyclable at the end of the device's life, in order to reduce the environmental impact. The material may be a regular plastic or a bioplastic.

The bullet resistant portion of the barrier may be made from layered bullet resistant material, having a void therebetween. The void may be divided into segments. Thus, if one part of the security barrier is damaged due to incoming fire, other segments of the security barrier will continue to provide protection. An arrangement with multiple layers and voids is contemplated, also. The bullet-resistant part of the barrier should not only provide protection by stopping incoming fire, the barrier should also remain in place to continue to provide protection from personnel attempting to board the craft.

The security barrier 10 preferably has a height 12 of around 1-1.3 m, and a width 11 of 1-1.5 m. The top rails provided on cargo ships are typically around 1-1.2 m high, and the security barrier 10 should be formed to be a suitable height 12 to fit onto these rails. On typical vessels the kick board may have a height of 100-150 mm. Typically, the barrier 30 protrudes outwardly from the plate 20 by a distance of or has a depth of at least 700 mm, and preferably more than 750 mm.

It will be apparent that positioning a series of barriers abutting or in close proximity along a length of rail will avoid presenting a handhold or securement point to unwanted boarders or pirates who are outboard of the ship. Furthermore, the barriers may provide the crew with some protection from incoming fire.

For any of the embodiments described, the simplicity of the shape of the security device 10 allows the security barrier 10 to be installed in either inboard or outboard facing directions on the rails 61, and without interfering with existing components or equipment of the ship. It would also be possible to install other shaped devices alongside the security devices 10 in order to provide protection to rails which are curved or meet at a corner.

It is not necessary for the device 10 to rest on the top rail 61, when installed. Instead, the device 10 may be supported by the ship's deck 64 and/or by one of more of the rails 61 secured in a vertical position to the rail 61 or another part of the ship.

In other embodiments, a security device 10 may be provided that rests on a lower rail, and has a reduced overall height 12. A lower rail may be around 50%-75% of the height of the top rail. For example, the height 12 of the security device 10 may be around 0.5-0.9 m. Security devices of this type may be suitable for vessels (for example, yachts) that are smaller than full-sized cargo ships. Security devices may be reduced in size. Alternatively, the barrier may be coupled with a smaller plate.

In recent times, bomb-resistant flight bags have been employed for containing a bomb explosion during an air flight and to limit damage caused to the plane. Such bags employ fabric-type layers of material to contain the bomb blast. In an alternative arrangement to provide bullet-resistant protection to a vessel, a curtain of bullet-resistant material could be provided on the inboard side of a barrier. The curtain of material would extend along the length of the perimeter that requires bullet protection, secured to the top, or top and bottom of the barrier device.

In the embodiments above, the barrier is preferably generally rigid, and maintains its shape at all times. However, in other embodiments the barrier may be more flexible, so that it can be moved between a storage/transport configuration and a use configuration. In the storage/transport configuration, the barrier may be planar or substantially planar, which will assist with ease of transport or storage. In the use configuration, the barrier is bent through a greater angle, and takes a suitable form to provide an overhang, as described above. A free end of the barrier may be releasably attachable to a part of the panel, in order to maintain the curved shape of the barrier when in the use configuration.

In these embodiments, there may not be a slot defined between the barrier and the plate into which a rail may be received. Instead, a space may be defined within the barrier when it is in the use configuration, with the rail passing through the space.

In these embodiments it is envisaged that, as before, the bullet-resistant material will be provided (whether permanently or removably attached) on the panel. Preferably, the bullet-resistant material will be provided on the inboard side of the panel. Or the bullet-resistant material may be integrated as a component of the panel material.

In the embodiments described above, the security device comprises a barrier part, which provides an overhang, and a plate part, which is oriented generally vertically in use. These two parts are removably attachable to each other. In other embodiments, however, a single sheet of material (such as a plastics material) may be provided, which can be bent and/or deflected to form both a barrier part, providing an overhang, and a plate part, which is oriented generally vertically in use. For instance, a lower part of the sheet may be arranged to be generally vertical. An upper part of the sheet may be bent in a curved shape to form an overhang, with the free end of the upper part of the sheet being connectable to a middle part of the sheet by any suitable means. In this way, the lower region of the sheet forms a plate part, and the upper region of the plate forms a barrier part, but both parts are formed from one unitary sheet.

It is envisaged that, in embodiments of the invention, a single sheet may form both a plate and a barrier in this way, and that a bullet-resistant material may be attached to a part of the single sheet. For instance, a generally planar sheet of a bullet-resistant material may be attached to the lower region of the single sheet. The bullet-resistant material may be attached to the inner or outer (i.e. inboard or outboard) side of the lower region. The bullet-resistant material may be attached to the lower region of the single sheet prior to installation. Alternatively, the single sheet may be installed in place, and the bullet-resistant material may be subsequently attached to it.

As discussed above, an advantage of a security device of this kind is that the single sheet may be at least partially unfolded, and laid flat or substantially flat, to improve the ease of storage and/or transportation.

Once again, these embodiments may not include a slot defined between the barrier and the plate into which a rail may be received. Instead, a space may be defined within the upper portion of the single sheet when it is in the use configuration, with the rail passing through the space.

It is envisaged that the bullet-resistant material will be provided as a planar or substantially planar sheet, but this need not be the case.

In some embodiments, the bullet-resistant material may be attached to the upper region of the single sheet, or to both the upper and lower regions of the single sheet.

The above description focuses on ships. However, it is also envisaged that the security devices described above may be used with other open water craft such as barges, hovercraft and catamarans. The security devices 10 may also be used in other situations where people may attempt to climb up and over a rail or wall. For instance, the security devices may be used on oil rigs and or other platforms or in prisons.

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

The invention claimed is:

1. A security device comprising:

a barrier; and a plate or panel, wherein the barrier and plate are releasably attachable to each other, and when the barrier and plate are attached the device comprises a slot for receiving a rail and the device may hang on a rail with the rail received in the slot, and the barrier protrudes in a horizontal direction, perpendicular from a plane extending downwardly from the rail, to provide an overhang; and wherein a bullet-resistant material, being at least a Type I bullet-resistant item, is removably attached to at least a portion of the plate.

2. The security device according to claim 1, wherein the security device may be transitioned repeatedly between a first configuration and a second configuration, in the first configuration the security device is unassembled and at least the barrier may be arranged in a storage configuration in which the barrier curves or bends through a first angle, and in the second configuration the security device is assembled in an arrangement for use, in which the security device may be assembled around a rail; and wherein, in the second configuration, at least a part of the panel is orientated to be substantially vertical, and the barrier is curved, bent or folded through a second angle, which is greater than the first angle, to protrude away from the panel in a horizontal direction, perpendicular from a plane extending vertically through the rail, to provide an overhang on an exterior side of the rail; and wherein at least a portion of the panel is made from a bullet-resistant material.

3. The security device according to claim 2, wherein the bullet-resistant material is a composite material, a laminate material, a mesh, a curtain or a sheet metal.

4. The security device according to claim 2, wherein the bullet-resistant portion of the device has voids, wherein, in use, the voids may be filled with an energy absorbent material, wherein the energy absorbent material is water or sand.

5. The security device according to claim 1, wherein the barrier is made from a molded polymer plastic material.

6. The security device of claim 1, wherein the plate is selected from a Type II bullet-resistant item, a Type III bullet-resistant item, or a Type IV bullet-resistant item.

7. The security device of claim 1, wherein the plate extends over a first height and the barrier extends over a second height that is shorter than the first height.

8. The security device of claim 1, wherein, in use, the plate and the barrier may be adjustably positioned relative to each other to correspondingly adjust the overall height of the device.

9. The security device of claim 1, wherein both the plate and the barrier have at least one attachment point for securing the security device to a rail.

10. The security device according to claim 1, wherein the security device further comprises a plurality of attachments, wherein the panel and the barrier may be releasably attached to each other and a rail using the plurality of attachments, and wherein at least a portion of the panel is made from a bullet-resistant material, and wherein the panel, barrier, and plurality of attachments comprise a kit.

11. A security device comprising:

a barrier; and a panel, wherein the barrier and the panel are parts of a unitary sheet of material, wherein, the security device may be transitioned repeatedly between a first configuration and a second configuration, in the first configuration the security device is unassembled and at least the barrier may be arranged in a storage configuration in which the barrier curves or bends through a first angle, and in the second configuration the security device is assembled in an arrangement for use, in which the security device may be assembled around a rail; and wherein, in the second configuration, at least a part of the panel is orientated to be substantially vertical, and the barrier is curved, bent or folded through a second angle, which is greater than the first angle, to protrude away from the panel in a horizontal direction, perpendicular from a plane extending vertically through the rail, to provide an overhang on an exterior side of the rail; and wherein bullet-resistant material, being at least a Type I bullet-resistant item, is removably attached to a lower region of the unitary sheet of material.

12. A method of providing bullet-resistant protections, comprising the steps of:

providing at least one security device according to claim 1; and attaching the security devices to a perimeter rail.

13. The method of claim 12, wherein at least two security devices are provided and respective sides of the at least two security devices are positioned in close proximity to form a substantially continuous barrier.

14. The method according to claim 12, wherein a bullet-resistant portion of the at least one security device has voids, wherein, in use, the voids may be filled with an energy absorbent material, the method further comprising the step of:

filling the void with water via a hose attached to an inlet in the at least one security device or filling the void with sand.

15. The method according to claim 12, wherein at least one non-bullet-resistant device is secured to the perimeter rail and further comprising a step of identifying critical areas and non-critical areas, wherein bullet-resistant security devices are used to protect critical areas and non-bullet-resistant security devices are used to protect non-critical areas.

* * * * *